US009221023B2

(12) United States Patent
Sugioka

(10) Patent No.: US 9,221,023 B2
(45) Date of Patent: Dec. 29, 2015

(54) LIQUID MIXING APPARATUS

(75) Inventor: Hideyuki Sugioka, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 1113 days.

(21) Appl. No.: 13/013,652

(22) Filed: Jan. 25, 2011

(65) Prior Publication Data

US 2011/0186435 A1 Aug. 4, 2011

(30) Foreign Application Priority Data

Jan. 29, 2010 (JP) ..... 2010-019442

(51) Int. Cl.

| | |
|---|---|
| ***B01F 5/06*** | (2006.01) |
| ***B01F 13/08*** | (2006.01) |
| ***B01F 13/00*** | (2006.01) |
| ***F04B 19/00*** | (2006.01) |

(52) U.S. Cl.

CPC ..... *B01F 13/00* (2013.01); *B01F 13/0059* (2013.01); *F04B 19/006* (2013.01)

(58) Field of Classification Search

CPC ..... F04B 19/006; B01F 13/0059

USPC ..... 366/273, 274, DIG. 4, 340; 204/453, 204/454, 458, 450

See application file for complete search history.

(56) References Cited

U.S. PATENT DOCUMENTS

| | | | | |
|---|---|---|---|---|
| 5,985,119 | A * | 11/1999 | Zanzucchi et al. | 204/450 |
| 7,081,189 | B2 | 7/2006 | Squires | |
| 7,691,244 | B2 * | 4/2010 | Levitan et al. | 204/450 |
| 2003/0164296 | A1 | 9/2003 | Squires et al. | |

FOREIGN PATENT DOCUMENTS

| | | | |
|---|---|---|---|
| JP | 2005-176836 | A | 7/2005 |
| JP | 4269001 | B1 | 5/2009 |

OTHER PUBLICATIONS

M.Z. Bazant and T.M.Squires,"Induced-Charge Electrokinetic Phenomena: Theory and Microfluidic Applications", The American Physical Society, Phys.Rev.Lett.92,066101(2004).

H.Zhao and H.Bau, "Microfluidic chaotic stirrer utilizing induced-charge electro-osmosis", The American Physical Society, Phys. Rev.E 75066217(2007).

* cited by examiner

*Primary Examiner* — Tony G Soohoo
*Assistant Examiner* — Anshu Bhatia
(74) *Attorney, Agent, or Firm* — Canon U.S.A., Inc. IP Division

(57) ABSTRACT

A liquid mixing apparatus includes a flow channel configured to supply a liquid therethrough; a vortex-flow generating unit including a conductive member and an electrode, and configured to generate a vortex flow in the liquid in the flow channel by an electric field, the conductive member being provided in the flow channel, the electrode applying the electric field to the conductive member; a directional-flow generating unit connected to an end portion of the flow channel and configured to generate a flow of the liquid in a direction along the flow channel; and a switching unit configured to switch between the vortex flow and the directional flow.

12 Claims, 13 Drawing Sheets

LIQUID MIXING APPARATUS

BACKGROUND OF THE INVENTION

1. Field of the Invention

The present invention relates to a liquid mixing apparatus that is usable in, for example, a small chemical analysis/synthesis system that performs chemical analysis and chemical synthesis at chip. More particularly, the present invention relates to a liquid mixing apparatus that makes use of induced charge electroosmosis.

2. Description of the Related Art

A micropump making use of electroosmosis is used in the field of, for example, Micro-Total Analysis System (μTAS) because, for example, the micropump is easily mounted in a very small flow channel (micro flow channel) having a relatively simple structure.

Accordingly, in recent years, a micropump making use of induced-charge electroosmosis (ICEO) is becoming the focus of attention because, for example, this type of micropump can increase the fluid rate of a liquid and can suppress chemical reaction occurring between an electrode and a liquid since AC driving can be performed.

U.S. Pat. No. 7,081,198 (hereunder may also be referred to as "Patent Document 1") and M. Z. Bazant and T. M. Squires, Phys. Rev. Lett. 92, 066101 (2004) (hereunder may also be referred to as "Non-Patent Document 1") each discuss a micromixer making use of induced-charge electroosmosis and a vortex flow caused by an ICEO flow around a circular cylindrical metallic post.

H. Zhao and H. Bau, Phys. Rev. E 75066217 (2007) (hereunder may also be referred to as "Non-Patent Document 2") discuss a mixing apparatus that alternately switches between two vortex flows by alternately applying a vertical electric field and an oblique electric field to a circular cylindrical metallic post.

In a very small flow channel, mixing by turbulent flow cannot be expected because the Reynolds number is low. Therefore, the mixing is primarily carried out by making use of molecular diffusion.

Consequently, in the micromixers that are discussed in Patent Document 1 and Non-Patent Document 1 and that cause vortices to be generated in micro flow channels by ICEO flow, time is required for achieving sufficient mixing and the required flow channel lengths are relatively long.

In contrast, in the mixing apparatus discussed in Non-Patent Document 2, an oblique electric field that is tilted in an oblique direction from a wall surface of a flow channel is required. Therefore, if one actually attempts to form the device, electrode arrangement needs to be considered. As a result, it may be difficult to achieve reduced size and integration.

SUMMARY OF THE INVENTION

The present invention provides a liquid mixing apparatus that can efficiently mix liquids in a short time, and that can be reduced in size and subjected to integration.

According to the present invention, there is provided a flow channel configured to supply a liquid therethrough; a vortex-flow generating unit including a conductive member and an electrode, and configured to generate a vortex flow in the liquid in the flow channel by an electric field, the conductive member being provided in the flow channel, the electrode applying the electric field to the conductive member; a directional-flow generating unit configured to generate a flow of the liquid in a direction along the flow channel; and a switching unit configured to switch between the vortex flow and the directional flow.

The liquid mixing apparatus according to the present invention includes a vortex-flow generating unit that generates a vortex flow in a liquid in a flow channel, a directional-flow generating unit that is connected to an end portion of the flow channel and that generates a flow in a direction along the flow channel, and a switching unit that switches between the vortex-flow generating unit and the directional-flow generating unit. In the liquid mixing apparatus, it is possible to switch between the vortex flow and the directional flow. This makes it possible to efficiently mix the liquid in a short time. Further, it is possible to provide a liquid mixing apparatus that does not require an oblique electric field and that can be easily reduced in size and subjected to integration.

Further features of the present invention will become apparent from the following description of exemplary embodiments with reference to the attached drawings.

DESCRIPTION OF THE EMBODIMENTS

A liquid mixing apparatus according to the present invention will hereunder be described with reference to the drawings.

The liquid mixing apparatus according to the present invention includes a flow channel configured to supply a liquid therethrough; a vortex-flow generating unit including a conductive member and an electrode, and configured to generate a vortex flow in the liquid in the flow channel by an electric field, the conductive member being provided in the flow channel, the electrode applying the electric field to the conductive member; a directional-flow generating unit configured to generate a flow of the liquid in a direction along the flow channel; and a switching unit configured to switch between the vortex flow and the directional flow.

Figure 1A:
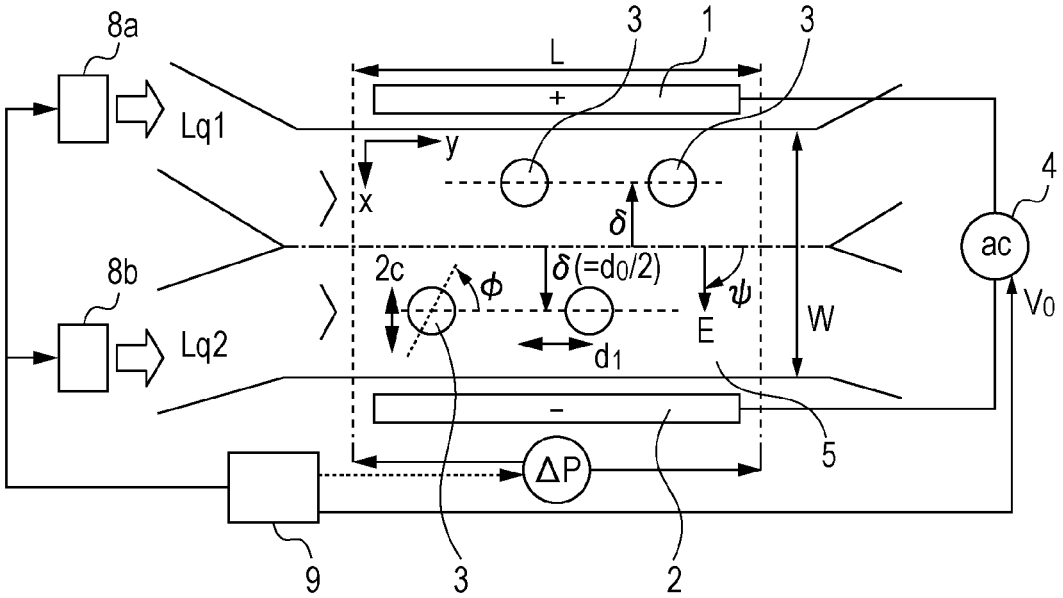
FIG. 1A is a schematic view of an exemplary liquid mixing apparatus according to the present invention.

FIG. 1A is a schematic view of an exemplary liquid mixing apparatus according to the present invention.

In FIG. 1A, reference numeral 5 denotes a flow channel (length L, width w, and depth d2 (not shown) (>w)) for supplying a liquid; reference numerals 3 denote conductive members provided in the flow channel; and reference numeral 4 denotes a power supply connected to electrodes 1 and 2 and applying an electric field to the conductive members 3. Here, the electrodes 1 and 2, the power supply 4, and the conductive members 3 constitute a vortex-flow generating unit that generates vortex flows in the liquid in the flow channel.

Reference numerals 8*a* and 8*b* denote pumps serving as directional-flow generating units that generate liquid flow in a direction along the flow channel (that is, a direction of extension of the flow channel). By operating these pumps, a pressure difference ΔP is occurs in the liquid at an inlet of the flow channel and at an outlet of the flow channel. Reference numeral 9 denotes a switching unit that switches between the flow channel generating unit and the directional-flow generating units.

In the liquid mixing apparatus shown in FIG. 1A, an electric field is generated by applying a voltage between the electrodes 1 and 2. By the electric field, an electric charge is induced at surfaces of the conductive members 3. A charging component (such as a positive ion or a negative ion) in the liquid is attracted to the induced electric charges, so that what is called an electric double layer is formed. Vortex flows are generated due to electroosmotic flow occurring at the electric double layer that forms a pair with the induced electric charge.

In the liquid mixing apparatus according to the present invention, it is possible to efficiently mix a liquid in a short time by switching between directional flow and vortex flow that provide liquid flow that is primarily generated in the flow channel.

Materials of the conductive members are those that induce an electric charge by an electric field. Examples thereof are carbon and carbon materials in addition to metals (such as gold and platinum). However, for the conductive members, it is desirable to use materials that are stable with respect to a liquid that is supplied.

In order to efficiently generate a vortex flow, it is desirable that more than one conductive member be provided in the flow channel. The number of conductive members can be selected considering, for example, the length of the flow channel, the sizes of the conductive members, and the viscosity of a liquid that is supplied.

From the viewpoint of efficiently generating a vortex flow, it is desirable that the conductive members be disposed in a zigzag arrangement in a direction of supply of a liquid with a centerline of the flow channel serving as a boundary. In FIG. 1A, a total of four conductive members are disposed, two at one side of the centerline and two at the other side of the centerline. However, any number of conductive members may be used.

For the electrodes that apply an electric field to the conductive members, the pair of electrodes 1 and 2 that are opposite each other are provided in FIG. 1. However, three conductive members or four or more conductive members may be disposed as long as an electric charge can be effectively induced at the conductor members. The electrodes are formed of, for example, gold, platinum, carbon, or carbon materials in addition to generally used electrode materials including, for example, metals. Although, in FIG. 1, driving is performed using an electric field by utilizing an AC (alternating-current) power supply as a power supply for generating a vortex flow, the driving may be performed by utilizing a DC (direct-current) power supply.

Although, in the present invention, various types of pumps may be used for the directional-flow generating units that generate directional flow along the flow channel, it is desirable to use micro-pumps such as electroosmotic pumps, electrophoretic pumps, piezoelectric actuator pumps, and diaphragm pumps that are generally used in the field of, for example, micro total analysis system (μTAS).

The switching unit that performs switching between the directional-flow generating units (pumps) and the vortex-flow generating unit can be formed using, for example, an arbitrary waveform generator having two channels.

This generator generates opposite phases in a rectangular wave (a gate pulse) at a channel 1 and at a channel 2, with the maximum value of the rectangular wave being 5 V (ON state) and the minimum value being 0 V (OFF state). The directional-flow generating units each have an interface that is controlled to the ON state or the OFF state in accordance with the gate pulse at the channel 1. The vortex-flow generating unit has an interface that is controlled to the ON state or the OFF in accordance with the gate pulse at the channel 2.

Obviously, the frequency and the peak driving voltages ($+V_0$, $-V_0$ in an ON state period at the channel 2 may be adjusted as appropriate for directly connecting an AC voltage to the electrodes. In addition, from the viewpoint of the structure of a small system, an electric circuit section including the switching unit can be integrated to an IC chip.

In the present invention, the flow channel used for supplying a liquid can be formed of a material that is generally used in the field of, for example, μTAS. More specifically, the flow channel can be formed of a material that is stable with respect to the liquid that is supplied, such as $SiO_2$, Si, fluorocarbon resin, and polymeric resins.

It is desirable that the size of the flow channel be large enough to be used as what is called a micro-reactor. A specific flow channel width is desirably less than or equal to 1000 μm, more desirably, less than or equal to 500 μm, and even more desirably, less than or equal to 200 μm. Decreasing the flow channel width decreases a distance of diffusion of the liquid, so that a mixing time is decreased and a reaction time is decreased. From the viewpoint of increasing a contact area between liquids that are mixed, it is desirable for the depth of the flow channel to be greater than the width of the flow channel. More specifically, the ratio of depth to channel width is desirably greater than or equal to 0.1, more desirably greater than or equal to 0.5, even more desirably greater than or equal to 1, and optimally greater than or equal to 2. Further, increasing the depth/flow channel width increases a sectional area of the flow channel, thereby allowing a large amount of fluid to flow.

In the present invention, the fluid that can be supplied in the flow channel basically include polar molecules containing charging components. Examples of the fluid include, for example, a solution including various types of electrolytes.

The present invention will hereunder be described in more detail with reference to specific embodiments.

First Embodiment

FIG. 1A is a sectional view of a mixing device according to a first embodiment. In the figure, reference numerals 1 and 2 denote a pair of electrodes, reference numerals 3 denote conductive members, reference numeral 4 denotes a power supply, and reference numeral 5 denotes a flow channel having a width w (=100 μm), a length L (=225 μm), and a depth $D_2$ (>w). The flow channel 5 is filled with water or a solution that can be polarized, such as an electrolytic aqueous solution. Here, the pair of electrodes 1 and 2 are provided for applying a DC electric field or an AC electric field to the flow channel. The electrodes 1 and 2, the power supply 4, and the conductive members 3 constitute a vortex-flow generating unit that generates a vortex flow in a liquid in the flow channel.

Reference numerals 8*a* and 8*b* denote pumps serving as directional-flow generating units that are connected to end faces of the flow channel 5 and that generate flow in a direction along the flow channel.

Reference numeral 9 denotes a switching unit that alternately switches to directional flow generated by the directional-flow generating units 8*a* and 8*b* and a vortex flow generated by the vortex-flow generating unit.

In the present invention, it is possible to provide a high-performance liquid mixing apparatus (micromixer) that can reduce a flow channel length and time required for mixing by switching between the two flow types, that does not require oblique electric fields, and that facilitates size reduction and integration.

Here, the vortex-flow generating unit includes the conductive members 3 disposed in the flow channel 5, and the electrodes 1 and 2 that apply an electric field to the conductive members 3. The vortex-flow generating unit makes use of induced charge electroosmosis (ICEO) occurring at an electric double layer that forms a pair with an electric charge induced by the conductive members 3 by the electric field. Since a vortex flow generated by ICEO is used, the flow velocity of the vortex flow can be increased. In addition, since AC driving is possible, it is possible to prevent, for example, electrochemical reaction, which is a problem when DC driving is performed.

In the embodiment, each conductive member 3 is formed of a column having a radius c (diameter 2*c*). In FIG. 1A, ϕ denotes a parameter indicating a position on the column, and E denotes a perpendicular electric field that is perpendicular to the electrodes. The positions of the four columns are indicated by $(x_i, y_i)$ (i=1, 2, 3, 4). $2\delta(=d_0)$ indicates the distance between the columns in a direction x.

That is, the positions x of the columns at a lower portion of the flow channel are $x_1=x_3=0.5w+\delta$, and the positions x of the columns at an upper portion of the flow channel are $x_2=x_4=0.5w-\delta$. $y_1/w=0.45$, $y_2/w=0.9$, $y_3/w=1.35$, and $y_4/w=1.8$.

Figure 1B:
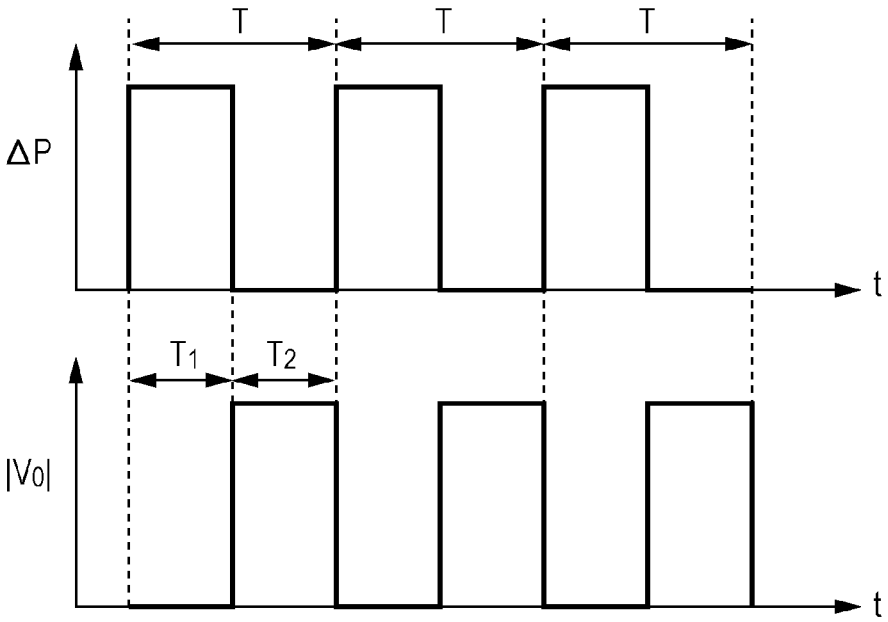
FIG. 1B is a timing chart showing an exemplary timing in which driving is switched by a switching unit.

FIG. 1B is a timing chart showing switching between driving by the directional-flow generating units and driving by the vortex-flow generating unit. $T_1$ denotes a pressure-difference application period (the pressure difference being a difference between the pressure at an inlet of the flow channel and the pressure at an outlet of the flow channel) caused by the directional-flow generating units. $T_2$ denotes a period of application of an AC voltage by the vortex-flow generating unit. $T=T_1+T_2$ indicates a switching period.

Figure 2A:
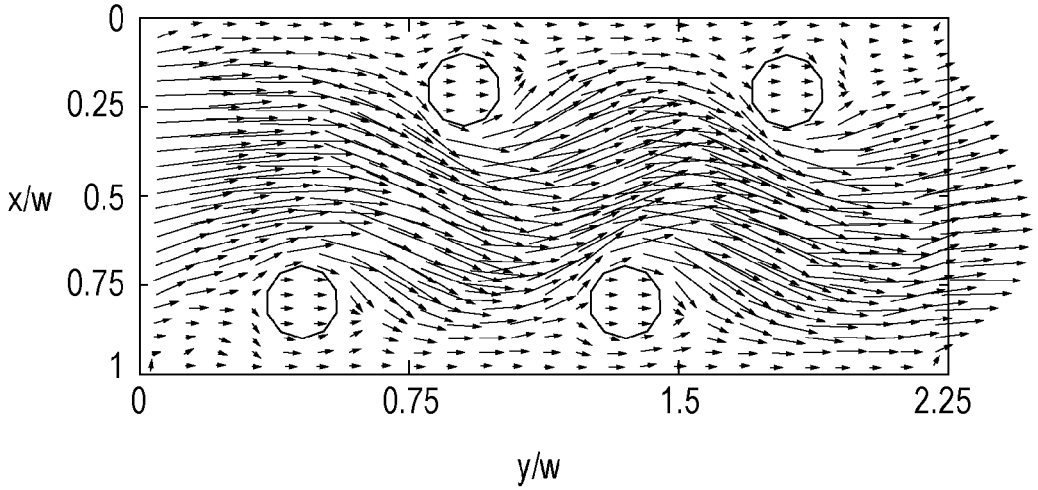
FIGS. 2A and 2B show liquid flow velocity distributions in the liquid mixing apparatus according to the present invention.
Figure 2B:
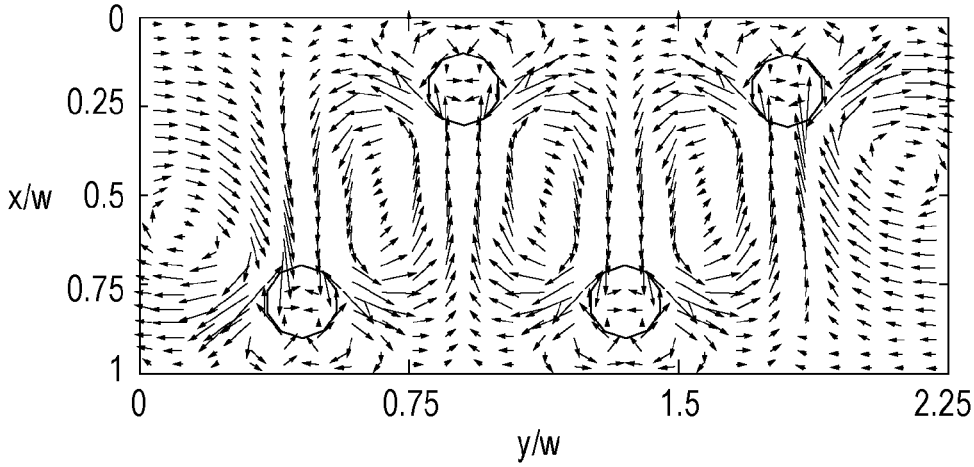
Figure 3:
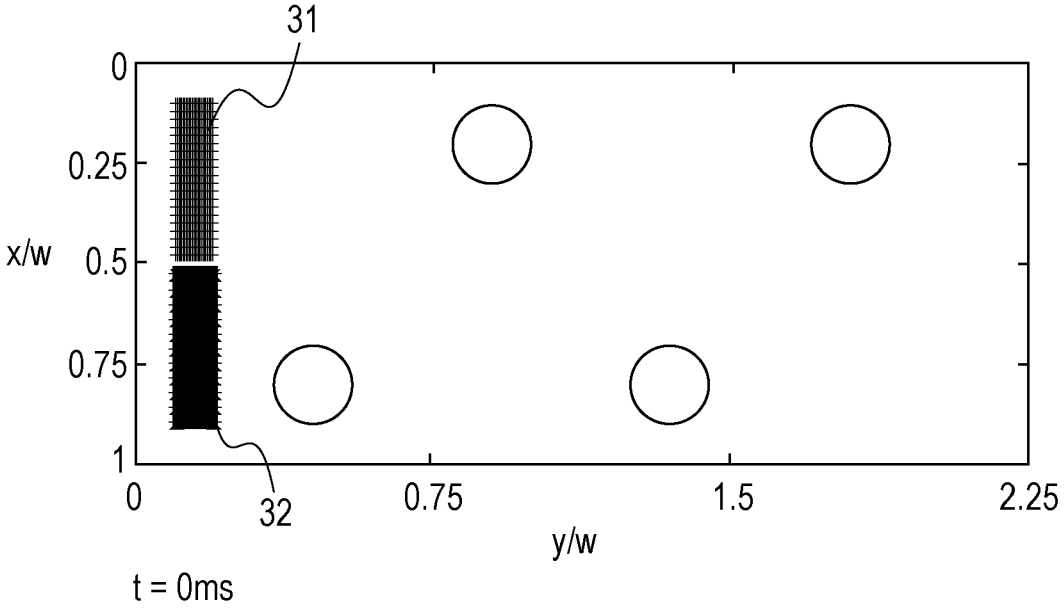
FIG. 3 shows the positions of liquids in the liquid mixing apparatus according to the present invention at a certain time.

FIGS. 2A and 2B show calculations of liquid flow velocity distributions in the liquid mixing apparatus according to the embodiment of the present invention. FIG. 2A shows the flow-rate distributions of directional flows that are generated by the directional-flow generating units 8*a* and 8*b*. FIG. 2B shows the flow-rate distribution of the vortex flow that is generated by the vortex-flow generating unit.

Calculation values here are calculated using Stokes' fluid equation in which an induced charge electroosmosis effect is considered. In the calculation, c/w=0.1, and δ/w=0.3; the difference between the pressure at the inlet of the flow channel and the pressure at the outlet of the flow channel caused by the directional-flow generating units is ΔP=2.4 Pa (pressure gradient ΔP/L); w=100 μm; L/w=2.25; and applied voltage $V_0$ of the vortex-flow generating unit is 2.38 V.

Figure 4:
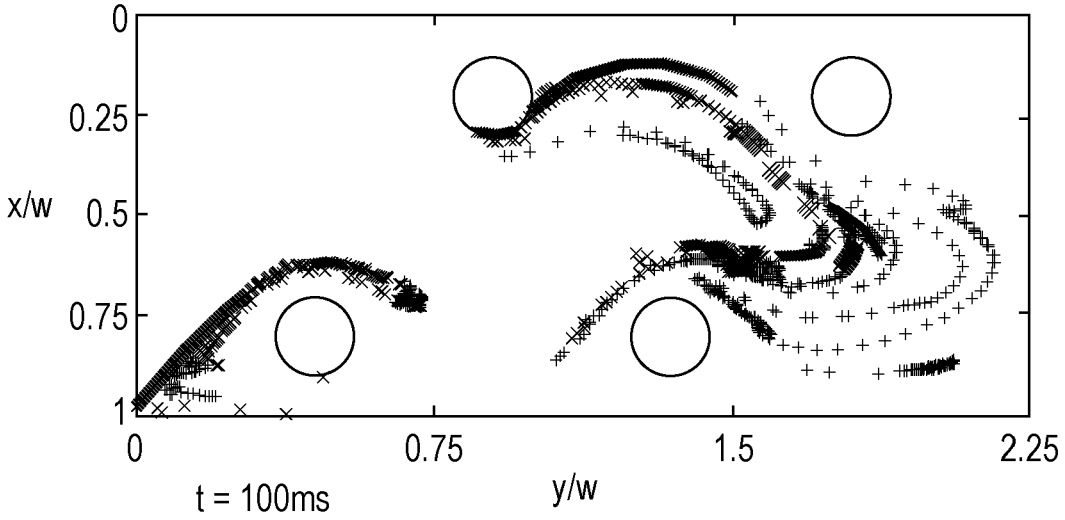
FIG. 4 shows the positions of the liquids in the liquid mixing apparatus according to the present invention at a certain time.
Figure 5:
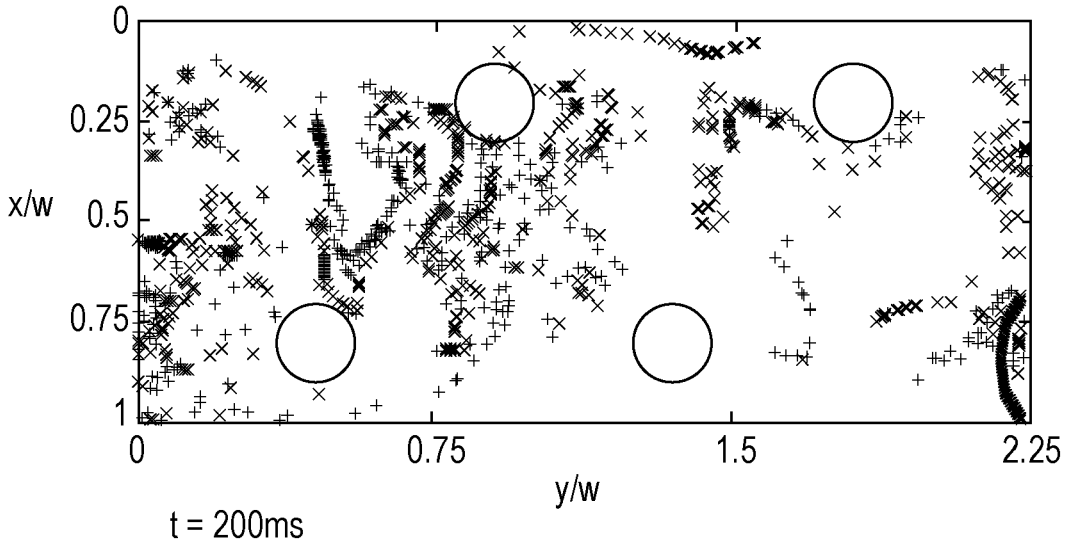
FIG. 5 shows the positions of the liquids in the liquid mixing apparatus according to the present invention at a certain time.
Figure 6:
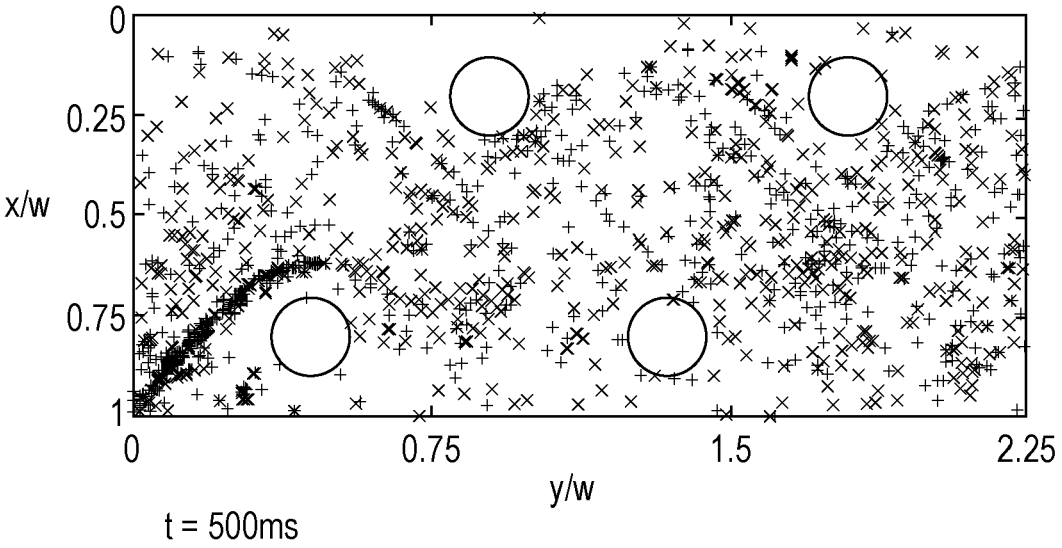
FIG. 6 shows the positions of the liquids in the liquid mixing apparatus according to the present invention at a certain time.

FIGS. 3, 4, 5, and 6 show positions of liquids in the liquid mixing apparatus that are calculated using periodic boundaries. Two types of liquids (Lq1 and Lq2 in FIG. 1 that flow into the inlet of the flow channel 5) are indicated by reference numerals 31 and 32 in FIG. 3 (t=0). Changes in the positions of the two types of liquids with time are shown in FIG. 4 (t=100 ms), FIG. 5 (t=200 ms), and FIG. 6 (t=500 ms). From FIG. 6, it can be understood that the two types of liquids are mixed well at a time of approximately 500 ms. Here, the period of generation of the directional flows and the period of generation of the vortex flow are T/2=20 ms.

Figure 7A:
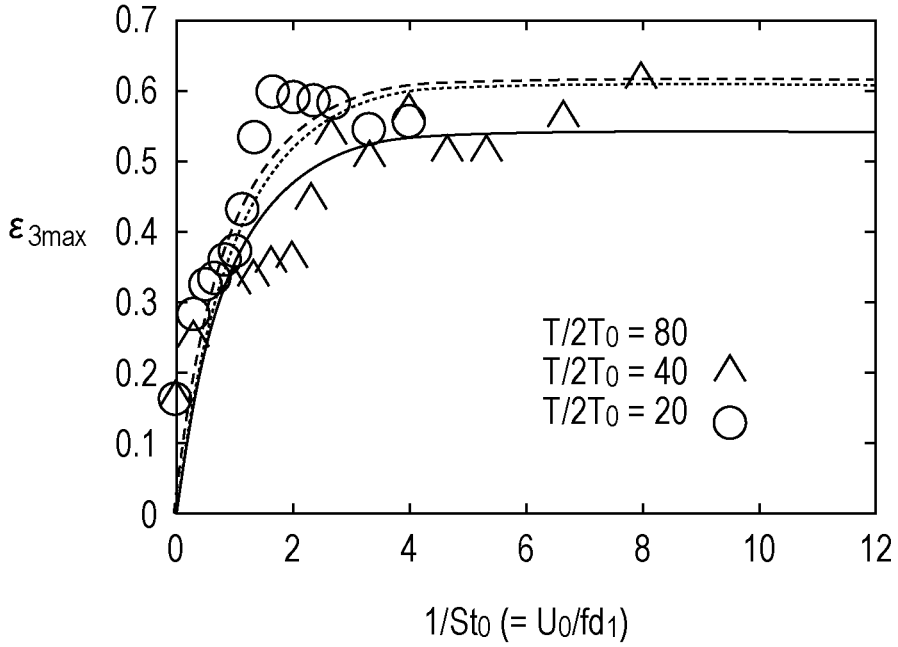
FIGS. 7A and 7B are graphs each showing the relationship between mixing coefficient and Strouhal number.
Figure 7B:
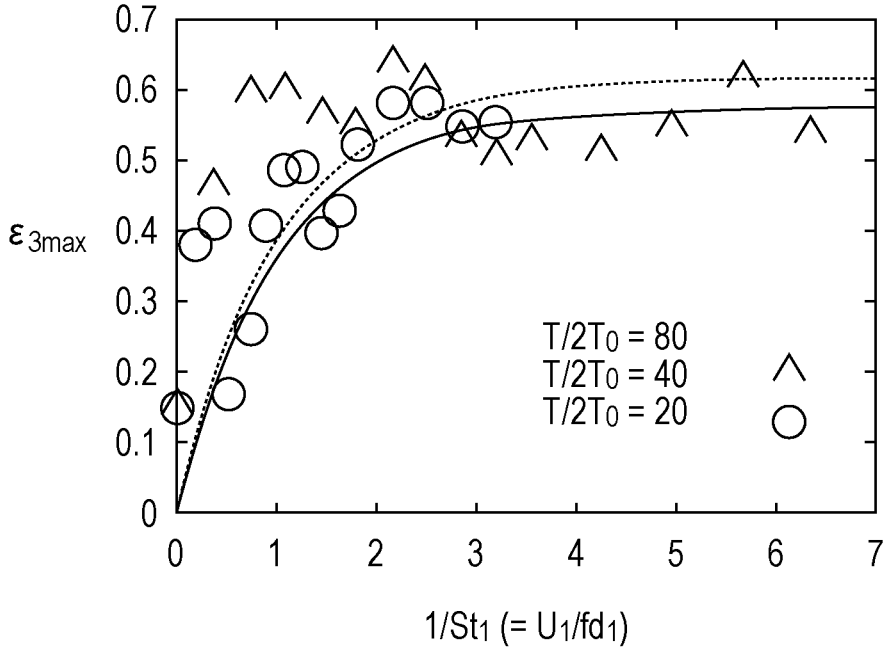

FIGS. 7A and 7B are graphs each show that a mixing coefficient ($\epsilon_{3,\ max}$) depends upon Strouhal number $St_1=fd_1/U_1$, $St_0=fd_0/U_0$. The mixing coefficient indicates the degree of mixing of the liquids after passage of a sufficient time, and is defined by a Box measurement method used to quantitatively assess the mixing.

Here, the Strouhal number is a dimensionless number for an inertial force based on a change with time and for an inertial force based on movement. f represents a switching frequency, $d_1$ represents a width of the vortex flow in the direction along the flow channel, $d_0$ represents a width of the vortex flow that is perpendicular to the direction along the flow channel, $U_1$ represents an average flow velocity of the liquids in the direction along the flow channel, and $U_0$ represents a speed of the vortex flow in the perpendicular direction.

The mixing coefficient is defined by:

$$\varepsilon_3 = \frac{1}{K}\sum_{i=1}^{k}\omega_i$$

where $\omega_i=n_i/n_{ave}$ when $n_i<n_{ave}$, and $\omega_i=1$ in other cases. $n_{ave}=N_3/K$, $N_3=(N_1N_2)^{0.5}$, and $n_i=(n_1n_2)^{0.5}$. $n_1$ and $n_2$ are the number of virtual fluid particles 1 and 2 in boxes. $N_1=N_2=20\times 40=800$ represents the total number of fluid particles 1 and 2. $K=10\times 20=200$ represents the number of evaluation boxes.

Here, $\omega_i=n_i/n_{ave}$ becomes a low value in a box containing the number of particles that is less than or equal to the average number of particles; and becomes 1 in a box containing the number of particles that is excessively larger than the average number of particles, which indicates that the liquids are mixed well. (The closer $\epsilon_3$ is to 1, the better the liquids are mixed together, whereas the closer $\epsilon_3$ is to 0, the less the liquids are mixed together.) Therefore, as the fluid particles of the two types of liquids 31 and 32 are uniformly spread in the entire flow channel, the closer the mixing coefficient is to 1, so that the liquids are mixed well as a whole.

From FIGS. 7A and 7B, it can be understood that the liquids are mixed well when $St_1=fd_1/I_1<1$, $St_0=fd_0/U_0<1$.

Figure 8A:
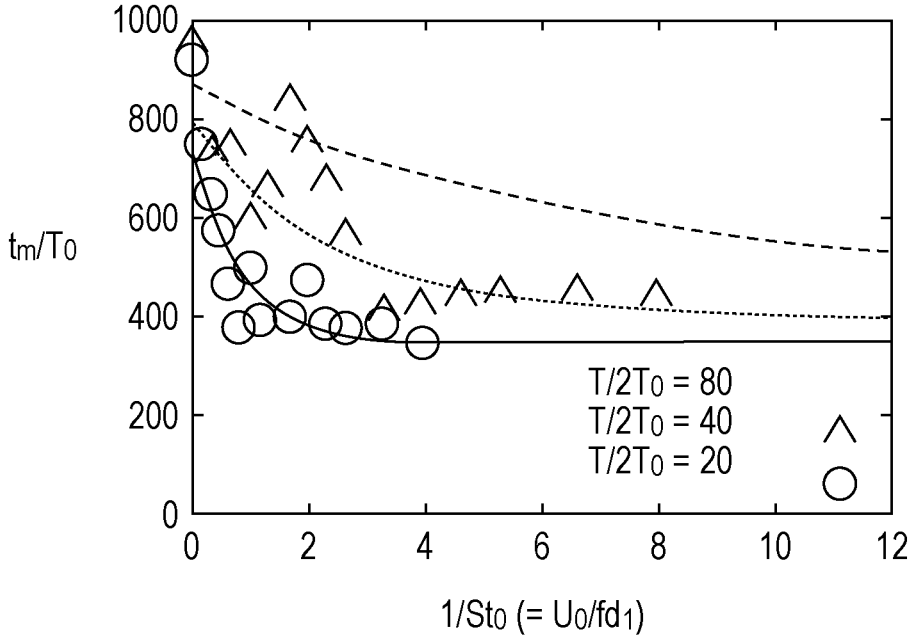
FIGS. 8A and 8B are graphs each showing the relationship between mixing time and Strouhal number.
Figure 8B:
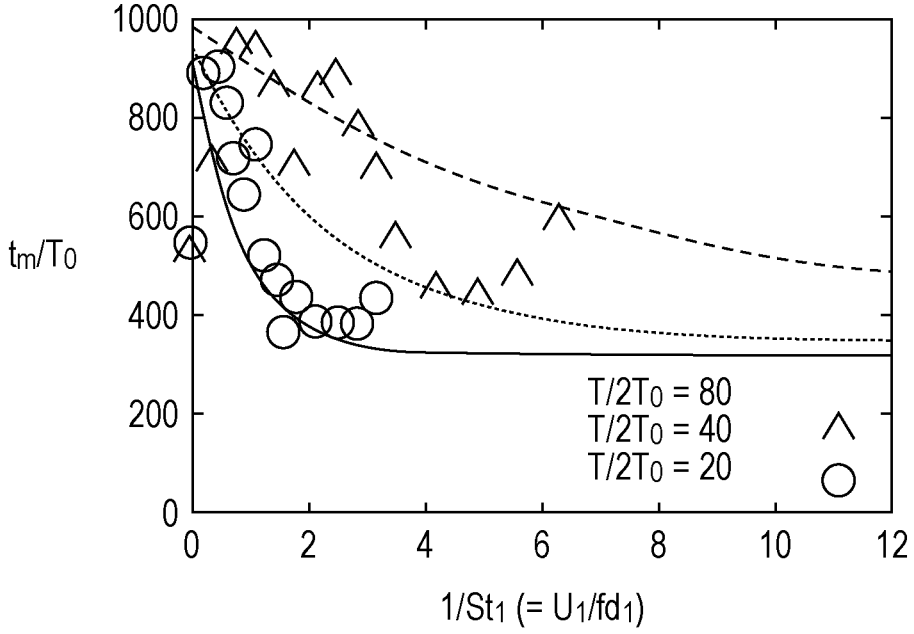
Figure 9A:
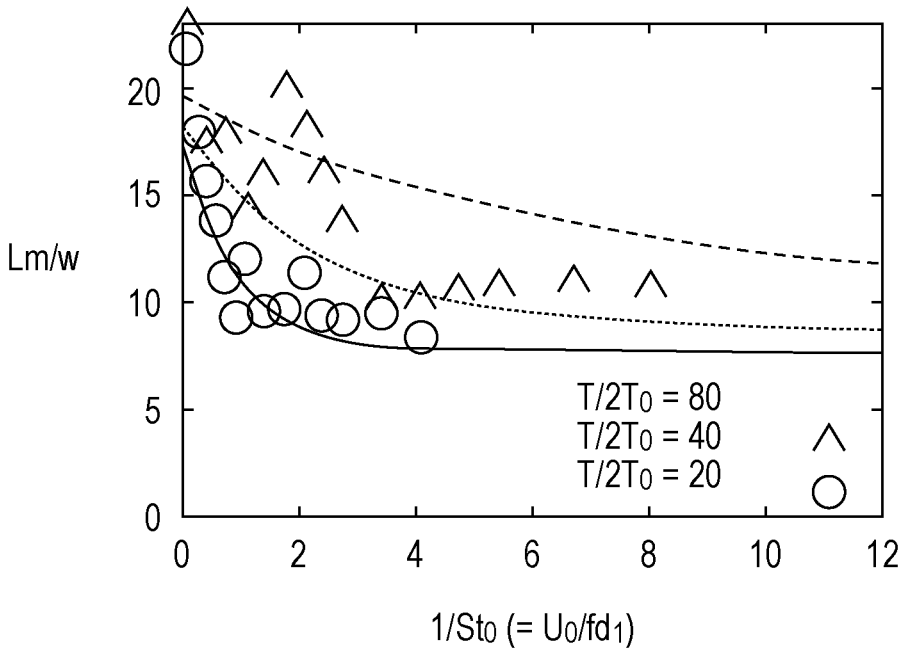
FIGS. 9A and 9B are graphs each showing the relationship between mixing time and Strouhal number.
Figure 9B:
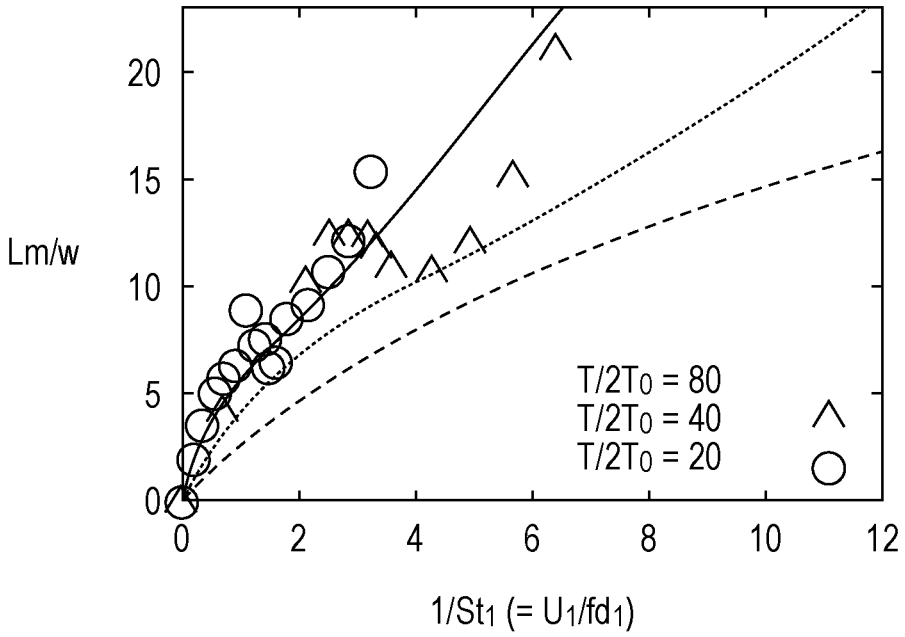
Figure 10:
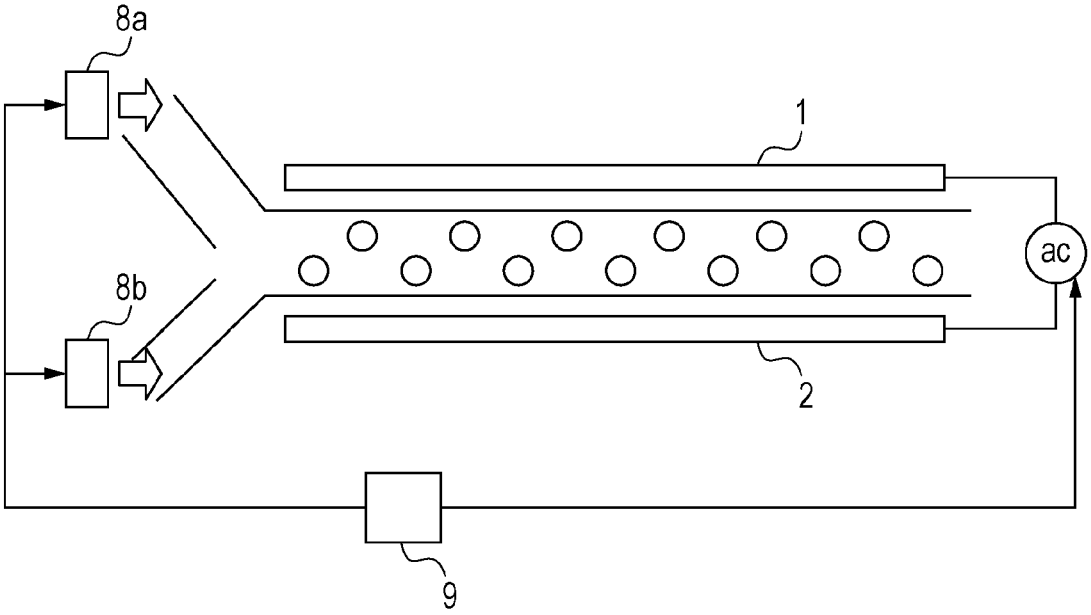
FIG. 10 is a schematic view of an exemplary liquid mixing apparatus according to the present invention.

FIGS. 8A and 8B are graphs each showing the relationship between mixing time $t_m$ and Strouhal number. FIGS. 9A and 9B are graphs each showing the relationship between mixing length $L_m$ and Strouhal number.

From FIGS. 8A to 9B, it can be understood that, when $St_1=fd_1/U_1<1$ and $St_0=fd_0/U_0<1$, $t_m$ is approximately 1 s and $L_m$ is approximately 1 mm, so that the liquids are sufficiently mixed in a short time and with a short distance. However, $T_0$=1 ms. The solid line, the broken line, and the dotted line represent analytic solutions based on a simple model when the switching times $T/(2T_0)$ are equal to 20, 40, and 80. The mixing distance $L_m$ is a distance required in the actual flow channel that does not use periodic conditions as in FIG. 3. Here, $L_m=U_1t_m$.

Ordinarily, it is said that, in a flow channel having a channel width of approximately 100 μm, a mixing time of approximately 60 s and a mixing length of approximately 1 cm are required. It can be understood that the present invention makes it possible to considerably reduce the mixing time and the mixing length. In the calculation, it is considered that the Reynolds number is 0 and that the Peclet number is infinitely large. Here, the Peclet number is a dimensionless number related to a diffusion coefficient. When the Peclet number is infinitely large, the diffusion coefficient is 0.

It can be understood that, since, in the present invention, chaotic mixing in which switching is performed between a plurality of flow types is performed, the present invention is effective even if the Reynolds number is very small and the Peclet number is large.

The liquid mixing apparatus according to the present invention is very useful in a micro-fluidic system in which the Reynolds number is small and liquids cannot be mixed by turbulent flow. The liquid mixing apparatus according to the present invention is applicable to various fields to which the micro-fluidic system is applicable. More specifically, the liquid mixing apparatus is applicable to, for example, DNA and protein analysis, cell sorting, high throughput screening, chemical reactions, and a movement unit for movements by a very small amount (1-100 n1).

Since the molecular weight is large in DNA, protein, and a cell, the diffusion coefficient is small, and the Peclet number of the system is very large. Therefore, the mixing apparatus according to the present invention that is effective even if the Peclet number is infinitely large is very useful. In addition, ordinarily, a micro-fluidic device that is used in, for example, a chemical analysis is required to have a simple structure that is not expensive and that is disposable. Even from this viewpoint, the present invention provides a suitable mixing apparatus.

Comparative Example 1

FIGS. 11A to 12B show the positions of liquids in a liquid mixing apparatus when a vortex flow and directional flows are generated at the same time without switching between the vortex flow and the directional flows.

Figure 11A:
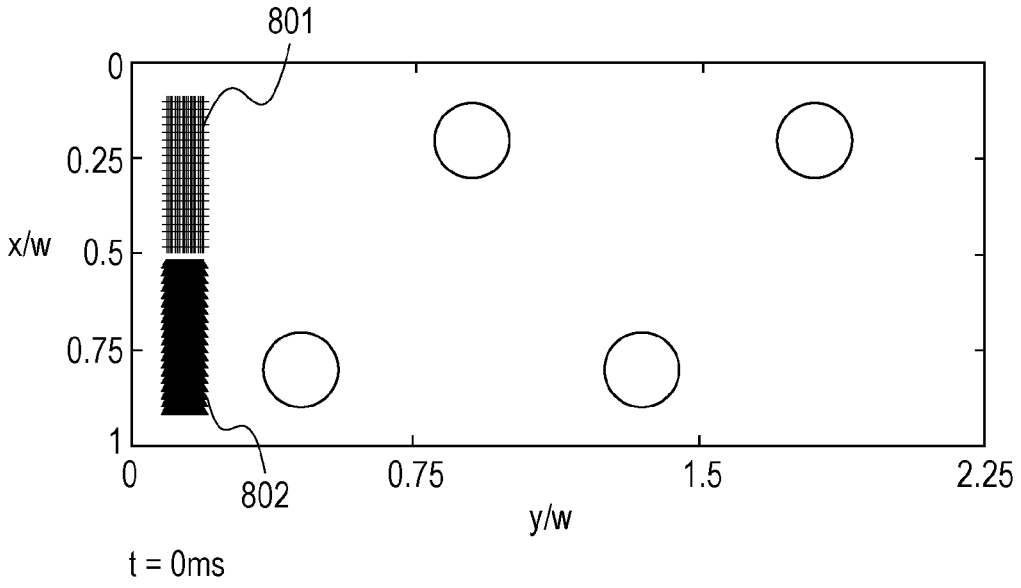
FIGS. 11A and 11B each show the positions of liquids in a liquid mixing apparatus in a comparative example.
Figure 11B:
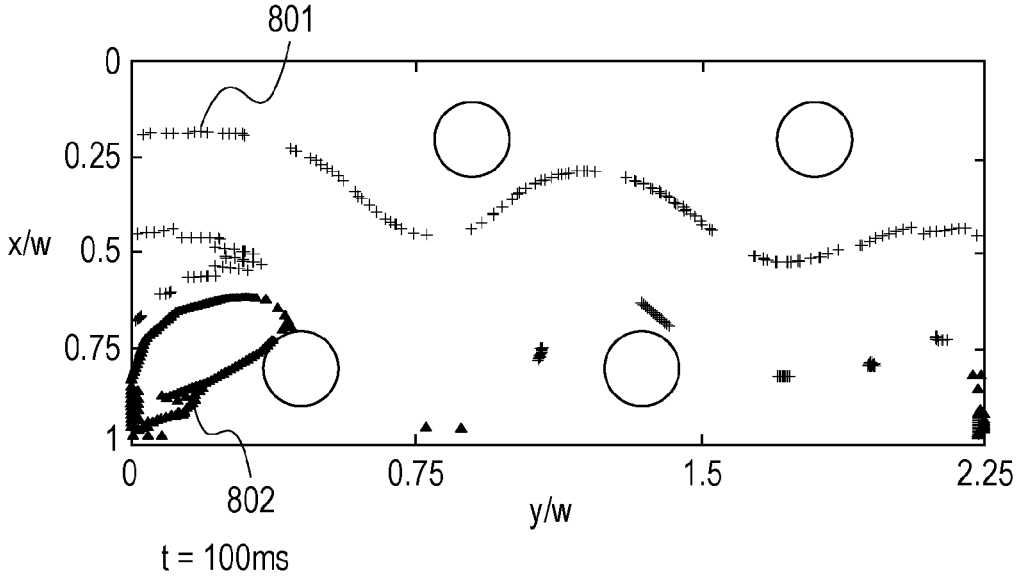
Figure 12A:
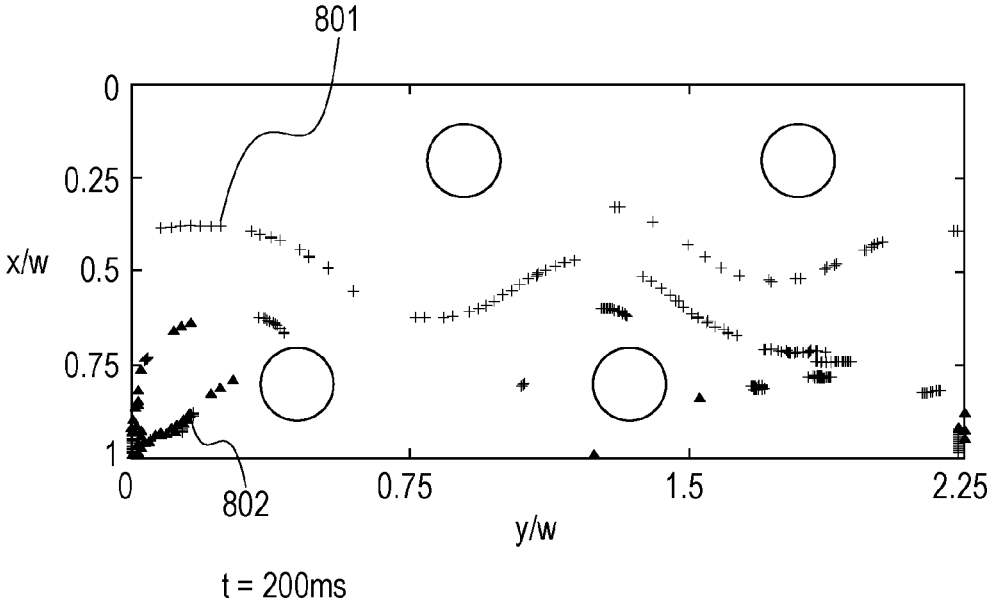
FIGS. 12A and 12B each show the positions of the liquids in the liquid mixing apparatus.
Figure 12B:
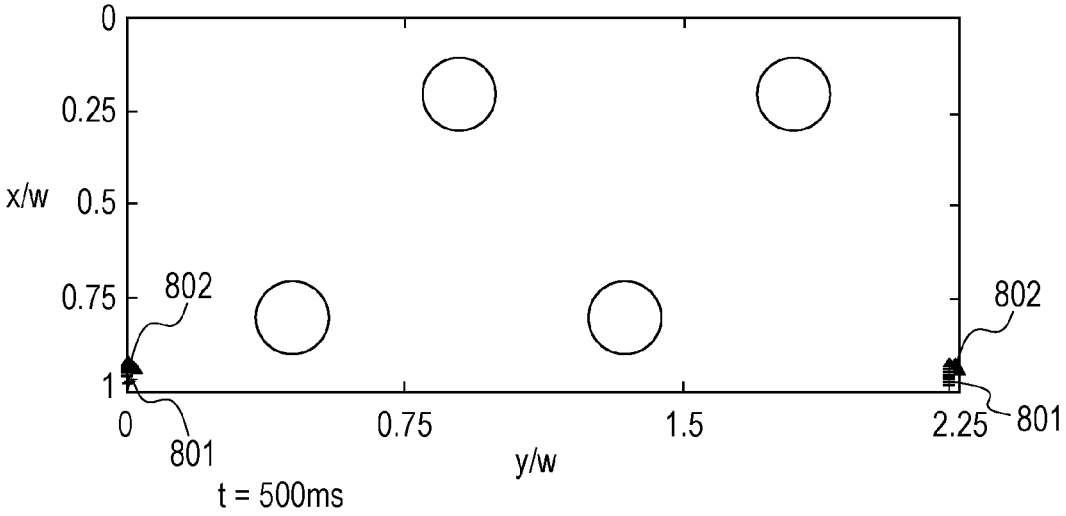

In these figures, the two types of liquids to be mixed are indicated by reference numerals 801 and 802. Changes in the positions with time are indicated in FIG. 11A (t=0 ms), FIG. 11B (t=100 ms), FIG. 12A (t=200 ms), and FIG. 12B (t=500 ms).

From these figures, it can be understood that, in the mixing apparatus according to the comparative example in which switching between the vortex flow and the directional flows is not performed, unlike the mixing apparatus according to the first embodiment, the liquids are not mixed well with the passage of time.

That is, when molecular diffusion is very small, the liquids are not mixed well unless switching is performed between the vortex flow and the directional flows.

Second Embodiment

Figure 13:
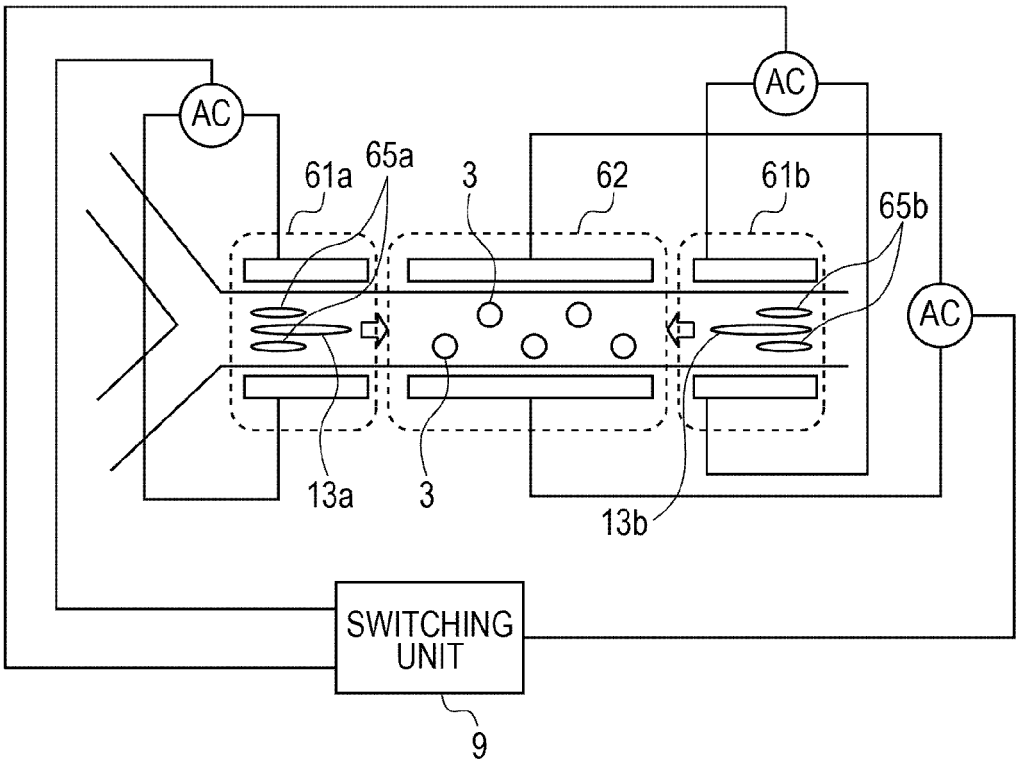
FIG. 13 is a schematic view of an exemplary liquid mixing apparatus according to the present invention.

FIG. 13 illustrates the feature of a liquid mixing apparatus according to a second embodiment of the present invention. The mixing apparatus according to the second embodiment includes directional-flow generating units 61*a* and 61*b* instead of the directional-flow generating units 8*a* and 8*b* (pumps) in the first embodiment.

The directional-flow generating units 61*a* and 61*b* are formed by disposing suppressing members 65*a* on respective sides of an elliptical conductive member 13*a* and by disposing suppressing members 65*b* on respective sides of an elliptical conductive member 13*b*. The suppressing members 65*a* and 65*b* suppress a flow in a reverse direction in a liquid flow that is generated by applying an electric field to conductive members.

Reference numeral 62 denotes a vortex-flow generating unit that is of the same type as that in the first embodiment.

In the mixing apparatus according to the second embodiment, a power supply connected to the vortex-flow generating unit 62 and power supplies connected respectively to the directional-flow generating unit 61*a* and the directional-flow generating unit 61*b* are connected to a switching unit 9, so that the liquid flow can be controlled.

In the mixing apparatus, with the direction of liquid flow from left to right in FIG. 13 being a forward direction, a forward-direction flow generated by the directional-flow generating unit 61*a*, a vortex flow generated by the vortex-flow generating unit 62, a reverse-direction flow generated by the directional-flow generating unit 61*b*, and a vortex flow generated by the vortex-flow generating unit 62 can be successively generated (that is, can be alternately switched).

In the mixing apparatus according to the embodiment that performs switching in this way, a practical flow channel length can be considerably reduced to 3L=approximately 6.75 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-019442 filed Jan. 29, 2010, which is hereby incorporated by reference herein in its entirety.

What is claimed is:

1. A liquid mixing apparatus comprising:

a flow channel that supplies a liquid therethrough;

a vortex-flow generating unit including a conductive member and an electrode, the vortex-flow generating unit generating a vortex flow in the liquid in the flow channel by an electric field, wherein the conductive member is provided in the flow channel, and the electrode applies the electric field to the conductive member;

a directional-flow generating unit that generates a flow of the liquid in a direction along the flow channel; and a switching unit, which is connected to both the vortex-flow generating unit and the directional-flow generating unit, that sends control signals to the vortex-flow generating unit and the directional-flow generating unit to alternately switch between driving the flow in the flow channel using the vortex-flow generating unit and driving the flow in the flow channel using the directional-flow generating unit, wherein the switching unit is configured such that alternately switching between driving the flow using the vortex-flow generating unit and driving the flow using the directional-flow generating unit is performed at a prescribed frequency.

2. The liquid mixing apparatus according to claim 1, wherein the vortex-flow generating unit makes use of electroosmotic flow caused by an electric double layer formed at the conductive member by the electric field.

3. The liquid mixing apparatus according to claim 1, wherein the switching unit is configured to switch the direction of flow of the liquid caused by the directional-flow generating unit.

4. The liquid mixing apparatus according to claim 1, wherein a material of the conductive member is selected from metals or carbon materials.

5. The liquid mixing apparatus according to claim 1, wherein a plurality of the conductive member are provided.

6. The liquid mixing apparatus according to claim 5, wherein the conductive members are provided in a zigzag arrangement.

7. The liquid mixing apparatus according to claim 1, wherein the directional-flow generating unit comprises a pump.

8. The liquid mixing apparatus according to claim 7, wherein the pump is selected from electroosmotic pumps, electrophoretic pumps, piezoelectric actuator pumps and diaphragm pumps.

9. The liquid mixing apparatus according to claim 1, wherein the switching unit comprises an arbitrary waveform generator.

10. The liquid mixing apparatus according to claim 1, wherein a width of the flow channel is less than or equal to 1000 μm.

11. The liquid mixing apparatus according to claim 1, wherein a ratio of a depth of the flow channel to a width of the flow channel is greater than or equal to 0.1.

12. The liquid mixing apparatus according to claim 1, wherein the directional-flow generating unit comprises an elliptical conductive member.

* * * * *